US011452332B2

(12) United States Patent
Fujita

(10) Patent No.: US 11,452,332 B2
(45) Date of Patent: Sep. 27, 2022

(54) SHOE SOLE, AND SHOE PROVIDED WITH SHOE SOLE

(71) Applicant: ASICS CORPORATION, Kobe (JP)

(72) Inventor: Hisanori Fujita, Kobe (JP)

(73) Assignee: ASICS CORPORATION, Kobe (JP)

( * ) Notice: Subject to any disclaimer, the term of this patent is extended or adjusted under 35 U.S.C. 154(b) by 228 days.

(21) Appl. No.: 16/754,583

(22) PCT Filed: Oct. 10, 2017

(86) PCT No.: PCT/JP2017/036720
§ 371 (c)(1),
(2) Date: Apr. 8, 2020

(87) PCT Pub. No.: WO2019/073533
PCT Pub. Date: Apr. 18, 2019

(65) Prior Publication Data
US 2020/0253327 A1 Aug. 13, 2020

(51) Int. Cl.
*A43B 13/14* (2006.01)
*A43B 13/12* (2006.01)
(Continued)

(52) U.S. Cl.
CPC ..... *A43B 13/141* (2013.01); *A43B 13/125* (2013.01); *A43B 7/087* (2013.01);
(Continued)

(58) Field of Classification Search
CPC ..... A43B 7/087; A43B 7/088
See application file for complete search history.

(56) References Cited

U.S. PATENT DOCUMENTS 6,655,048 B2 * 12/2003 Moretti ..... A43B 7/08 36/3 R
6,769,202 B1 * 8/2004 Luthi ..... A43B 13/184 36/28
(Continued)

FOREIGN PATENT DOCUMENTS

EP 0 479 183 A2 4/1992
EP 479183 A * 4/1992 ..... A43B 13/14
(Continued)

OTHER PUBLICATIONS

Notification of Transmittal of Copies of Translation of the International Preliminary Report on Patentability issued in PCT/JP2017/036720; dated Apr. 16, 2020.
(Continued)

*Primary Examiner* — Jila M Mohandesi
(74) *Attorney, Agent, or Firm* — Studebaker & Brackett PC

(57) ABSTRACT

A shoe sole, to which an upper member is joined, the shoe sole including a bottom receiving part corresponding to a bottom of the upper member, and a rising part that is formed to rise upwardly from an upper side of the bottom receiving part so as to cover an outer surface of a side of the upper member, wherein the bottom receiving part is formed with vent grooves each recessed in a thickness direction from the upper surface of the bottom receiving part, wherein the rising part is formed with vent holes each penetrating therethrough in a thickness direction of the rising part, and wherein the vent hole is formed to have a vertically elongated shape extending from an upper end side to a lower end side of the rising part, and to be in communication with the vent groove.

6 Claims, 9 Drawing Sheets

(51) Int. Cl.
*A43B 7/08* (2022.01)
*A43B 7/144* (2022.01)
*A43B 13/18* (2006.01)

(52) U.S. Cl.
CPC ..... *A43B 7/088* (2013.01); *A43B 7/144* (2013.01); *A43B 13/181* (2013.01)

(56) References Cited

U.S. PATENT DOCUMENTS

| | | | | |
|---|---|---|---|---|
| 6,948,260 | B2 * | 9/2005 | Lin | A43B 7/125 36/3 B |
| 8,793,902 | B2 * | 8/2014 | Besanceney, III | A43B 13/125 36/30 R |
| 9,510,640 | B2 | 12/2016 | Bier et al. | |
| 2011/0154693 | A1 * | 6/2011 | Oberschneider | A43B 17/08 36/25 R |
| 2012/0174444 | A1 * | 7/2012 | Besanceney, III | A43B 13/125 36/43 |
| 2013/0160223 | A1 * | 6/2013 | Bier | B29D 35/122 12/146 B |
| 2013/0232824 | A1 | 9/2013 | Bier et al. | |

FOREIGN PATENT DOCUMENTS

| | | | | |
|---|---|---|---|---|
| EP | 0 479 183 | B1 | 7/1996 | |
| JP | H04-263801 | A | 9/1992 | |
| JP | 3108843 | U | 4/2005 | |
| JP | 2013-536709 | A | 9/2013 | |
| WO | WO-2012028209 | A1 * | 3/2012 | A43B 13/12 |

OTHER PUBLICATIONS

International Search Report issued in PCT/JP2017/036720; dated Dec. 26, 2017.

* cited by examiner

SHOE SOLE, AND SHOE PROVIDED WITH SHOE SOLE

FIELD

The present invention relates to a shoe sole having a ventilation structure for ensuring the breathability, and a shoe provided with the shoe sole.

BACKGROUND

Conventionally, there has been provided a shoe configured to draw the air into the shoe, while drawing the air out of the shoe, by means of a ventilation structure formed in a shoe sole thereof.

For example, the shoe disclosed in Patent Document 1 is provided with a shoe sole including a midsole having an elasticity, and a plurality of vent grooves extending in a shoe width direction are formed in an upper side of a rear part of the midsole.

According to the aforementioned shoe sole, the rear part of the midsole is compressed and deformed in the thickness direction when the rear part of the midsole is depressed by the wearer who lands on the heel while walking. The compression and deformation causes the volume of the vent grooves to be reduced, and the air in the vent grooves, that is, the air between the sole of the foot of the wearer and the upper side of the midsole, to be drawn out of the shoe through both ends in the longitudinal direction of each of the vent grooves.

Subsequently, once the depression of the rear part of the midsole is released when the wearer lifts the foot, the shape of the rear part of the midsole is restored. This restoration causes the volume of the vent grooves to be restored, and the air outside the shoe to be drawn into the shoe through the both ends of each of the vent grooves.

The aforementioned shoe sole is thus described to be capable of ensuring the breathability of the sole of the foot of the wearer while walking.

Meanwhile, the entire inside of the shoe, that is, not only the sole of the foot of the wearer, but also the medial and lateral sides of the foot are filled with moisture and heat. Thus, according to the aforementioned conventional shoe sole, the air is likely to stay in the regions proximal to the inside and outside of the foot. Therefore, there is a concern that the comfort of wearing is impaired due to the causes such as stuffiness.

CITATION LIST

Patent Literature

Patent Literature 1: JP 3108843 U

SUMMARY

Technical Problem

In view of the aforementioned circumstances, it is an object of the present invention to provide a shoe sole that can improve the breathability in the shoe, and a shoe that includes the shoe sole.

Solution to Problem

A shoe sole of the present invention is a shoe sole, to which an upper member is joined, the shoe sole comprising a bottom receiving part, to which the upper member is directly or indirectly layered, and a rising part that is formed to rise upwardly from an upper side of the bottom receiving part so as to cover an outer surface of the side of the upper member, wherein the bottom receiving part is formed with at least one vent groove that is recessed in a thickness direction from the upper surface of the bottom receiving part, wherein the rising part is formed with at least one vent hole that penetrates therethrough in a shoe width direction of the shoe sole, and wherein the vent hole is formed to have a vertically elongated shape extending from an upper end side to a lower end side of the rising part, and to be in communication with the vent groove.

The shoe sole of the present invention may be configured such that the vent groove comprises a first vent groove extending straight from the vent hole toward a center in the shoe width direction of the shoe sole, and a pair of second vent grooves branching from a medial end in the shoe width direction of the first vent groove.

In this case, the pair of second vent grooves may be configured such that the distance between the pair of second vent grooves in the shoe longitudinal direction increases, as they advance toward the medial side in the shoe width direction.

The shoe sole of the present invention may be configured such that the rising part comprises a medial rising part that is formed on a medial edge side in the shoe width direction of the bottom receiving part, and a lateral rising part that is formed on a lateral edge side in the shoe width direction of the bottom receiving part, wherein the at least one vent hole is composed of a plurality of vent holes, wherein the plurality of vent holes comprise a medial vent hole formed in the medial rising part and a lateral vent hole formed in the lateral rising part, wherein the at least one vent groove is composed of a plurality of vent grooves, wherein the plurality of vent grooves comprise a medial vent groove that is located on the medial edge side of the bottom receiving part and continued to the medial vent hole, and a lateral vent groove that is located on the lateral edge side of the bottom receiving part and continued to the lateral vent hole, and wherein ends of the pair of second vent grooves included in the medial vent groove and ends of the pair of second vent grooves included in the lateral vent groove are respectively in communication with each other in the shoe width direction.

The shoe sole of the present invention may be configured such that the rising part has an inner surface comprising a joining surface, to which the upper member is joined, and a non-contact surface configured to be in non-contact with the upper member, and wherein the inner surface of the rising part is stepwisely formed so that the joining surface protrudes more on the medial side in the shoe width direction than the non-contact surface.

The shoe sole of the present invention may be configured such that the plurality of vent holes are formed in the rising part at intervals in the shoe longitudinal direction of the shoe sole, and wherein a vertically elongated columnar part extending from a lower end part to an upper end of the rising part is formed by a portion between each adjacent ones of the vent holes in the shoe longitudinal direction.

A shoe of the present invention includes any one of the aforementioned shoe soles, to each of which an upper member is joined.

DESCRIPTION OF EMBODIMENTS

Figure 1:
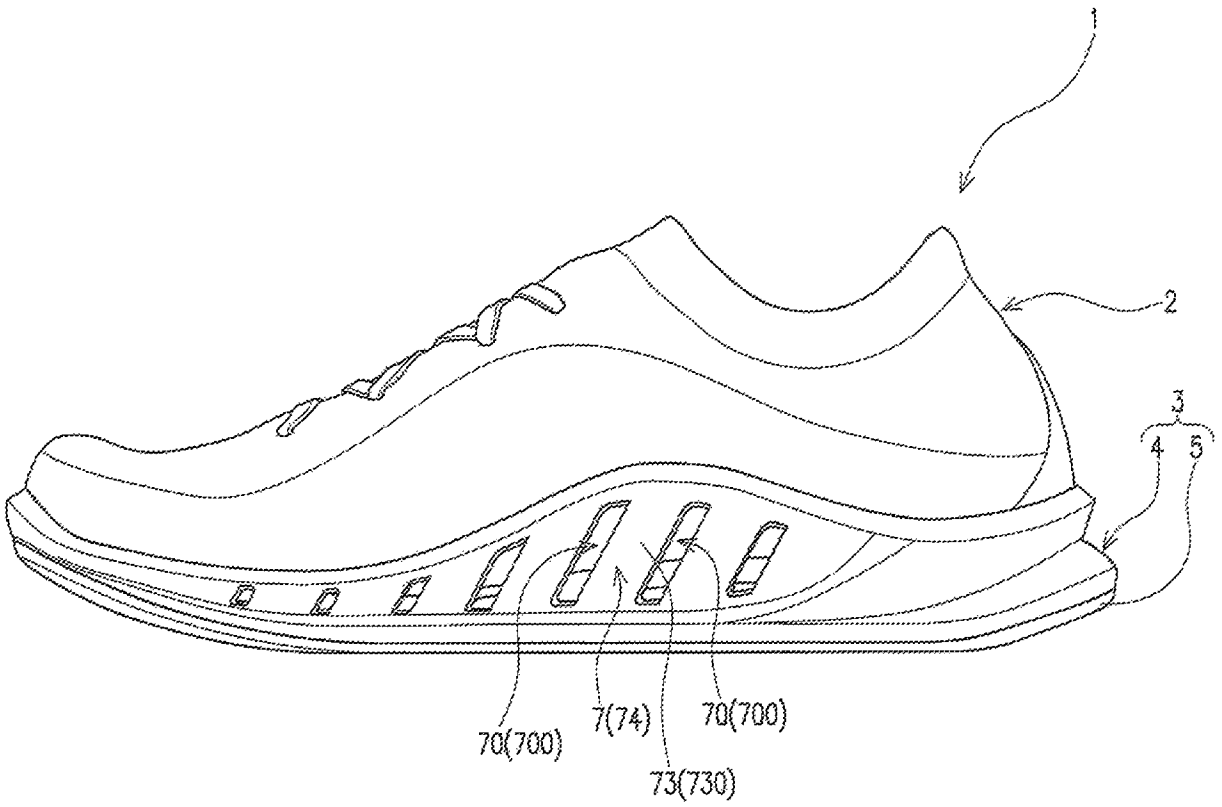
FIG. 1 is a side view of a shoe according to one embodiment of the present invention as viewed from a medial side in a shoe width direction.
Figure 2:
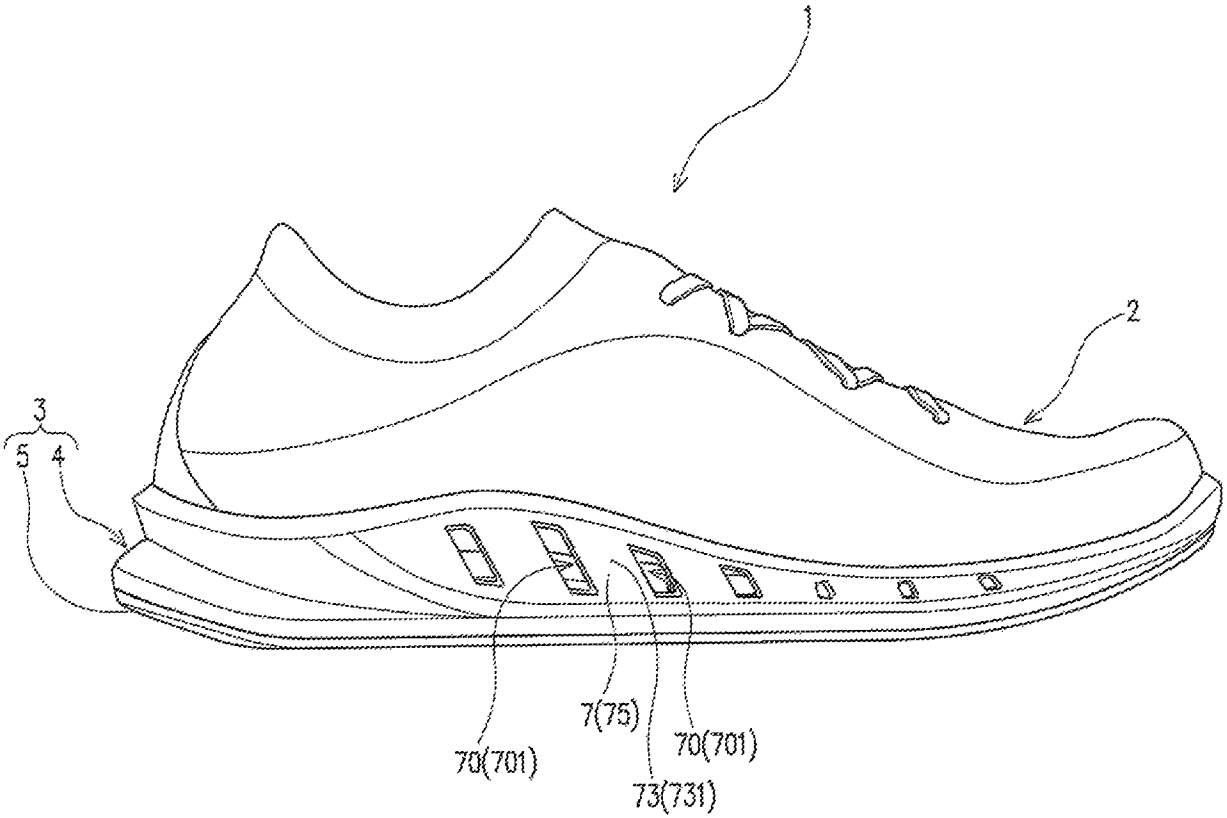
FIG. 2 is a side view of the shoe according to the embodiment as viewed from a lateral side in the shoe width direction.

Hereinafter, a shoe sole according to one embodiment of the present invention will be described. In this embodiment, a shoe sole 3 will be described by taking, for example, a shoe 1 that includes an upper member 2 to cover the dorsum of the foot of the wearer and a shoe sole 3 to which the upper member 2 is joined, as shown in FIG. 1 and FIG. 2.

In this embodiment, the following description will be made by referring to the direction in which the front part and the rear part of the shoe sole 3 are arranged as the shoe longitudinal direction, referring to the direction corresponding to the width of the shoe sole 3 as the shoe width direction, and referring to the direction corresponding to the thickness of the shoe sole 3 as the thickness direction.

The upper member 2 is configured to cover the foot of the wearer on the shoe sole 3. The upper member 2 according to this embodiment includes a bottom part to be in contact with the sole of the foot of the wearer, and side parts that are continued to the bottom part and cover the sides (a medial side and a lateral side) of the foot of the wearer. A plurality of through holes for ensuring the breathability are formed in the bottom part and the side parts.

The shoe sole 3 includes a midsole 4 and an outsole 5 to be joined to the underside of the midsole 4.

Figure 3:
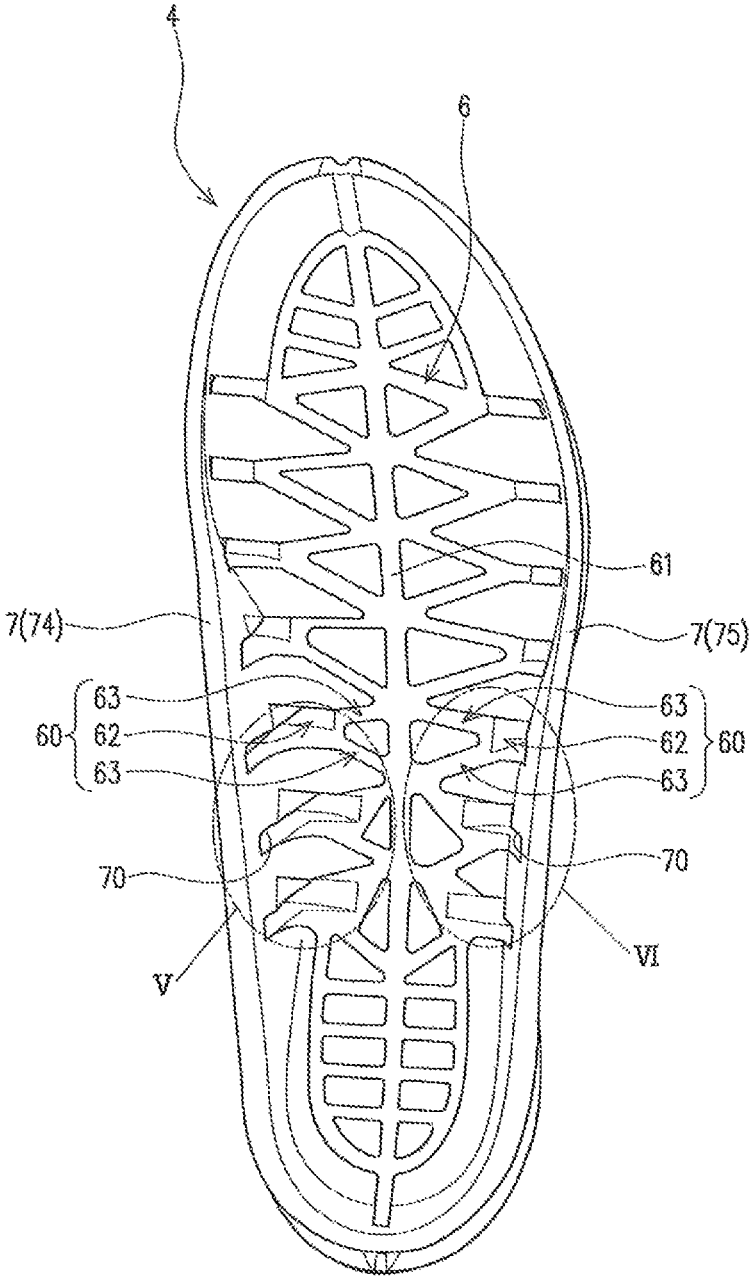
FIG. 3 is a top plan view of a shoe sole according to the embodiment.

The midsole 4 has an elasticity. As shown in FIG. 3, the midsole 4 has a bottom receiving part 6 on which the bottom part of the upper member 2 is layered, and a rising part 7 formed to rise from the upper side of the bottom receiving part 6 so as to cover the outer surface of the side of the upper member 2.

In the bottom receiving part 6, a plurality of grooves recessed in the thickness direction from the upper surface are formed, and the grooves include vent grooves 60 extending in the shoe width direction and a longitudinal groove 61 extending in the shoe longitudinal direction.

Each of the vent grooves 60 includes a first vent groove 62 extending from a side edge in the shoe width direction of the bottom receiving part 6 (a medial edge or a lateral edge in the shoe width direction of the bottom receiving part 6) toward a center in the shoe width direction of the bottom receiving part 6, and a pair of second vent grooves 63 branching from one end of the first vent groove 62 (specifically, one end located close to the center in the shoe width direction of the bottom receiving part 6).

The groove width of the first vent groove 62 (the groove width in the direction orthogonal to the direction in which the center line of the first vent groove 62 extends) is larger than the groove width of each of the second vent grooves 63 (the groove width in the direction orthogonal to the direction in which the center line of each of the second vent grooves 63 extends).

The first vent groove 62 has a bottom surface including an inclined surface 620 that is downwardly inclined toward the side edge in the shoe width direction of the bottom receiving part 6.

Further, in this embodiment, the distance between the pair of second vent grooves 63 in the shoe longitudinal direction gradually increases toward the center in the shoe width direction of the bottom receiving part 6.

The first vent groove 62 according to this embodiment extends straight from the side edge of the bottom receiving part 6 toward the center of the bottom receiving part 6. However, for example, both sidewalls in the groove width direction of the first vent groove 62 may be curved, or may have an uneven surface, provided that the center line of the first vent groove 62 is formed to extend in the shoe width direction or in the direction intersecting with the shoe width direction.

As shown in FIG. 3, a plurality of vent grooves 60 are formed at intervals in the shoe longitudinal direction in the bottom receiving part 6. More specifically, the plurality of vent grooves 60 are formed on the side close to the medial edge in the shoe width direction of the bottom receiving part 6 to be aligned away from each other in the shoe longitudinal direction, and the plurality of vent grooves 60 are also formed on the side close to the lateral edge in the shoe width direction of the bottom receiving part 6 to be aligned away from each other in the shoe longitudinal direction. In the following description on this embodiment, the vent groove 60 on the side close to the lateral edge of the bottom receiving part 6 may be referred to as a lateral vent groove 60, and the vent groove 60 on the side close to the medial edge of the bottom receiving part 6 may be referred to as a medial vent groove 60.

Figure 4:
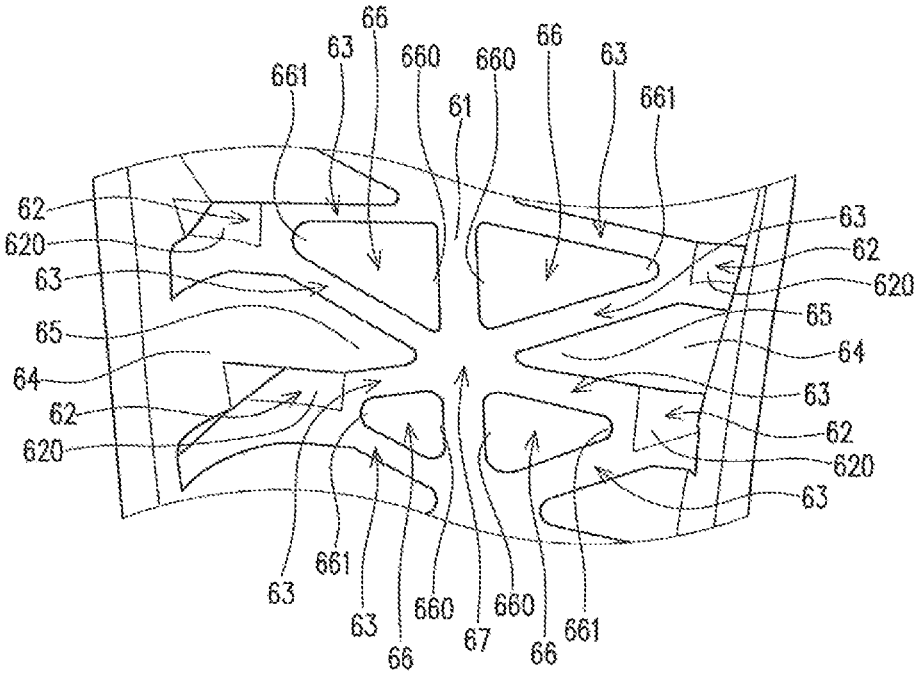
FIG. 4 is a partially enlarged plan view of a center part of the shoe sole in the shoe width direction according to the embodiment.

The first vent grooves 62 of the vent grooves 60 adjacent to each other in the shoe longitudinal direction are respectively arranged at intervals in the shoe longitudinal direction as shown in FIG. 4. Therefore, a support 64 (hereinafter referred to as a first support) for supporting the sole of the foot of the wearer is formed between each adjacent ones of the first vent grooves 62 aligned in the shoe longitudinal direction.

The second vent grooves 63 of each of the vent grooves 60 are formed to be aligned in the shoe longitudinal direction with the second vent groove 63 of another vent groove 60 adjacent to the each of the vent grooves 60 in the shoe longitudinal direction. Therefore, the distance in the shoe longitudinal direction between the second vent groove 63 of the each of the vent grooves 60 and the second vent groove 63 of the other vent groove 60 decreases toward the center part side of the bottom receiving part 6.

Further, in this embodiment, one end of the second vent groove 63 of each of the vent grooves 60 (one end located on the side close to the center of the bottom receiving part 6) is continued to one end of the second vent groove 63 of the other vent groove 60 (one end located on the side close to the center of the bottom receiving part 6).

Therefore, a support 65 (hereinafter referred to as a second support) continued to the first support 64 is formed between the second vent groove 63 of the each of the vent grooves 60 and the second vent groove 63 of the other vent groove 60. The second support 65 is formed so that the width in the shoe longitudinal direction gradually decreases toward the center of the bottom receiving part 6. That is, the second support 65 is tapered toward the center of the bottom receiving part 6.

Further, since the pair of second vent grooves 63 of each of the vent grooves 60 branch from one end of the first vent groove 62 to have a distance in the shoe longitudinal direction increasing therebetween toward the center of the bottom receiving part 6 as described above, a support (hereinafter referred to as a third support) 66 is also formed between the pair of second vent grooves 63 of each of the vent grooves 60.

The third support 66 is formed to have a width in the shoe longitudinal direction gradually increasing toward the center of the bottom receiving part 6. The third support 66 has a medial end 660 in the shoe width direction extending in the shoe longitudinal direction, and a lateral end 661 in the shoe width direction having a tapered shape.

The upper surfaces of the first support 64, the second support 65, and the third support 66 not only constitute the upper surface of the bottom receiving part 6, but also serve as the surface to which the bottom part of the upper member 2 is layered (joined).

The longitudinal groove 61 is formed to be open at the front end and the rear end in the shoe longitudinal direction of the shoe sole 3. In this embodiment, the longitudinal groove 61 and the second vent grooves 63 intersect with each other to thereby form intersection spaces 67 at the center of the bottom receiving part 6.

In this embodiment, the bottom part of the upper member 2 is directly layered (joined) to the upper surface of the bottom receiving part 6. However, it is also possible to indirectly layer (join) the bottom part of the upper member 2 to the upper surface of the bottom receiving part 6.

The upper member 2 is thermally fused to the bottom receiving part 6. For example, in the case where the upper member 2 is layered on the upper surface of the bottom receiving part 6 having an adhesive agent applied thereon, the breathability in the shoe 1 is impaired when the adhesive agent enters any of the vent grooves 60. However, when the upper member 2 is thermally fused to the bottom receiving part 6 as in this embodiment, the inside of each of the vent grooves 60 can be used entirely as an air flow path.

Figure 5:
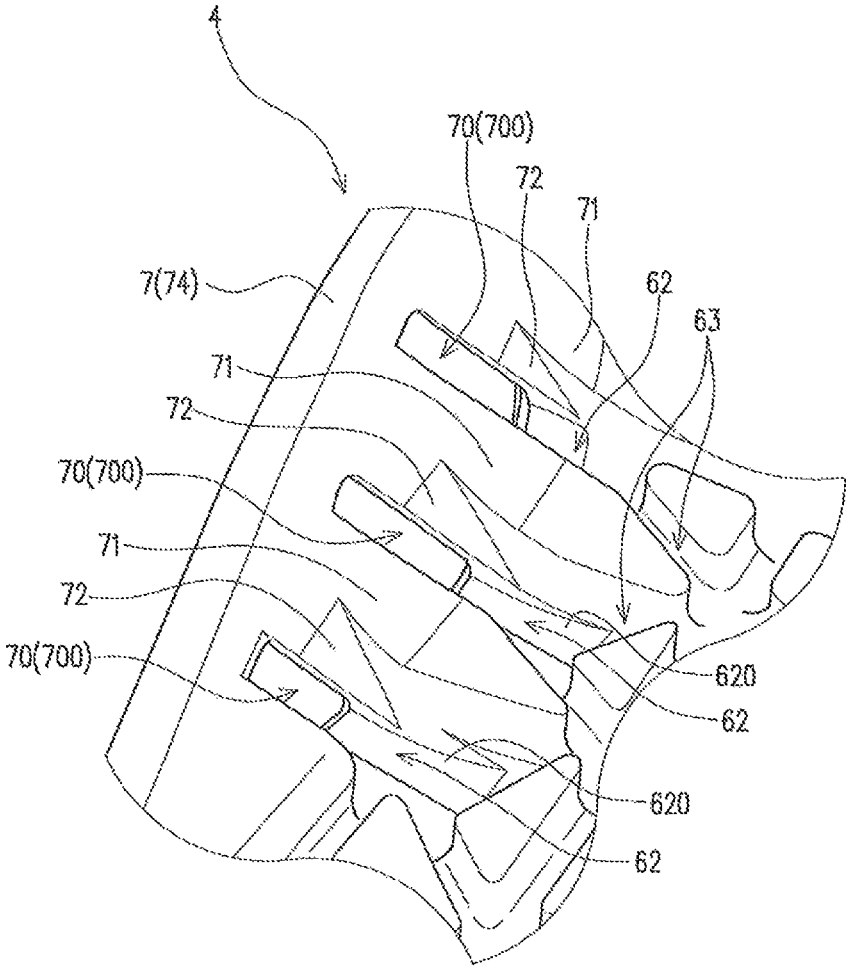
FIG. 5 is an enlarged diagonally backward perspective view of an inner side of a medial rising part of the shoe sole according to the embodiment.
Figure 6:
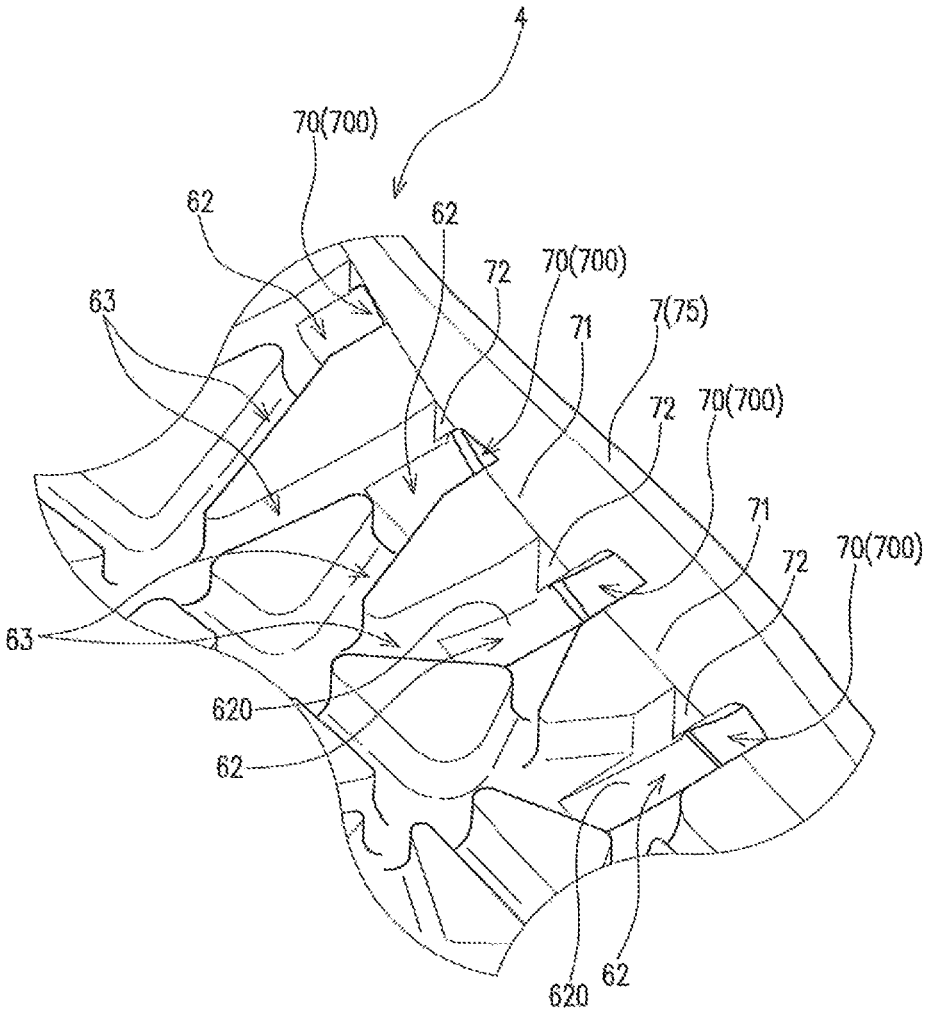
FIG. 6 is an enlarged diagonally backward perspective view of an inner side of a lateral rising part of the shoe sole according to the embodiment.

As shown in FIG. 5 and FIG. 6, the rising part 7 has a vent hole 70 penetrating therethrough in the thickness direction.

The vent hole 70 is formed to have a vertically elongated shape extending from the upper end side to the lower end side of the rising part 7. The vent hole 70 is gradually inclined toward the rear side in the shoe longitudinal direction as it advances from the lower end side to the upper end side.

Further, the lower end of the vent hole 70 is in communication with the other end of the vent groove 60 opposite to the aforementioned one end. Therefore, the vent hole 70 is formed to extend upwardly from an open end of the vent groove 60.

The rising part 7 of this embodiment has a plurality of vent holes 70 formed to be arranged at intervals in the shoe longitudinal direction.

The inner surface of the rising part 7 (the surface facing toward the center of the bottom receiving part 6) includes a joining surface 71 to which the upper member 2 is joined, and a non-contact surface 72 adjacent to the joining surface 71 in the shoe longitudinal direction. Further, there is a step between the joining surface 71 and the non-contact surface 72 since the joining surface 71 protrudes more on the medial side in the shoe width direction than the non-contact surface 72.

Further, in the rising part 7 according to this embodiment, a plurality of vertically elongated vent holes 70 are formed at intervals in the shoe longitudinal direction as described above, and thus a vertically elongated columnar part 73 extending from the lower end to the upper end of the rising part 7 is formed between each adjacent ones of the vent holes 70 in the shoe longitudinal direction as shown in FIG. 1 and FIG. 2. That is, in the rising part 7, the vent holes 70 and the columnar parts 75 are formed to be alternately arranged each other in the shoe longitudinal direction. The lower end of each of the columnar parts 73 is continued to the upper surface of the bottom receiving part 6.

In the shoe sole 3 according to this embodiment, one rising part 7 is formed on each of the medial edge side and the lateral edge side in the shoe width direction of the bottom receiving part 6.

Therefore, in this embodiment, the following description will be made by referring to the rising part 7 formed on the medial edge side of the bottom receiving part 6 as a medial rising part 74, referring to the rising part 7 formed on the lateral edge side of the bottom receiving part 6 as a lateral rising part 74, referring to the vent hole 70 formed in the medial rising part 74 as a medial vent hole 700, and referring to the vent hole 70 formed in the lateral rising part 75 as a lateral vent hole 701.

In the medial rising part 74 according to this embodiment, the maximum height in the thickness direction is set to about 25 mm from the bottom receiving part 6, and the height of the medial vent hole 700 formed near the top of the medial rising part 74 is set so that an upper end thereof is located at a height of about 15 mm from the bottom receiving part 6.

In the lateral rising part 74 according to this embodiment, the maximum height in the thickness direction is set to about 18 mm from the bottom receiving part 6, and the height of the lateral vent hole 701 formed near the top of the lateral rising part 74 is set so that an upper end thereof is located at a height of about 8 mm from the bottom receiving part 6.

In the rising part 7 (the medial rising part 74, the lateral rising part 75) according to this embodiment, the height of the vent hole 70 is set to, for example, about 30% or more, preferably 40% or more based on the height of the rising part 7 at a position corresponding to the position at which the vent hole 70 is formed. It is more preferable that such a height be set to 50% or more in the medial rising part 74 provided near an inner arch portion that is likely to have a space where moisture or heat inside the shoe 1 stay due to the skeletal characteristics of the foot.

When the height of the vent hole 70 from the bottom receiving part 6 in the rising part 7 (the medial rising part 74, the lateral rising part 75) is set to be higher than the thickness of the material that constitutes a bottom surface part of the upper member 2 (that is, when the vent hole 70 extends upwardly from the material that constitutes the bottom surface part of the upper member 2), the moisture and the heat staying near the bottom edge part inside the shoe 1 can be easily ventilated therefrom.

For example, when the upper member 2 is made by the shoemaking method such as the French seam method or the California method, the thickness of the material that constitutes the bottom surface part of the upper member 2 is generally about 1.5 mm to 3 mm, and thus the height of the vent hole 70 from the bottom receiving part is preferably set to 4 mm or more. When such a height is set to 8 mm or more, the moisture and the heat staying at the bottom edge portion inside the shoe 1 can be easily ventilated.

The configuration of the shoe 1 according to this embodiment is as described above. According to the shoe 1 of this embodiment, the mutual communication between the vent hole 70 having a vertically elongated shape extending from the upper end side to the lower end side of the rising part 7 and the vent groove 60 formed in the bottom receiving part 6 (in this embodiment, the medial vent hole 700 and the vent groove 60 on the medial edge side of the bottom receiving part 6; and the lateral vent hole 701 and the vent groove 60 on the lateral edge side of the bottom receiving part 6) thus forms a large space (hereinafter, referred to as a ventilation space) on the sides of the edge in the shoe width direction (the medial edge side and the lateral edge side of the bottom receiving part 6) of the bottom receiving part 6, the large space being in communication with the outside of the shoe sole 3 and extending from the bottom receiving part 6 to the upper end side of the rising part 7.

Therefore, the shoe 1 according to this embodiment enables the air to flow smoothly in the vent groove 60 through the ventilation space, and thereby can produce an excellent effect of improving the breathability inside the shoe 1.

Further, the first vent groove 62 located closer to the medial edge side or the lateral edge side of the bottom receiving part 6 than to the second vent groove 63 in the shoe width direction is formed to have a groove width on the upper end side (a groove width in the direction orthogonal to the direction in which the center line of the first vent groove 62 extends) larger than the groove width on the bottom side (a groove width in the direction orthogonal to the direction in which the center line of the first vent groove 62 extends), so that a non-contact portion with the sole of the foot of the wearer, namely, the ventilation space, is broadened on the side edge of the bottom receiving part 6 in the shoe width direction, and therefore the breathability inside the shoe 1 is further improved.

The bottom surface of the first vent groove 62 of this embodiment includes the inclined surface 620 that is inclined downwardly toward the side edge in the shoe width direction of the bottom receiving part 6, and thus the ventilation space is also broadened due to this configuration.

According to the shoe sole 3 of this embodiment, the pair of second vent grooves 63 are formed closer to the center of the shoe sole 3 than the first vent groove 62, that is, formed in the place where heat and moisture are more likely to stay than in the first vent groove 62. However, the air is suppressed from stay in the pair of the second vent grooves 63 since the pair of second vent grooves 63 are formed to branch from the inner end of the first vent groove 62.

More specifically, the groove width of each pair of second vent grooves 63 (the groove width in the direction orthogonal to the direction in which the center line of the second vent groove 63 extends) branched from the inner end of the first vent groove 62 is smaller than the groove width of the first vent groove 62.

Therefore, when the air outside the shoe sole 3 flows into the second vent groove 63 through the first vent groove 62, the flow speed of the air in the second vent groove 63 increases, so that the fresh air is easily distributed throughout the inside of the second vent groove 63.

The second vent groove 63 is formed to branch from the inner end of the first vent groove 62, so that the volume of the inside thereof is smaller than that of the first vent groove 62. Therefore, when the air in the second vent groove 63 is discharged to the outside of the shoe sole 3 through the first vent groove 62, all the air in the second vent groove 63 is easily discharged into the first vent groove 62 without remaining therein.

In this embodiment, since the pair of second vent grooves 63 is configured to allow a distance therebetween in the shoe longitudinal direction to increase toward the center in the shoe width direction of the shoe sole 3, the distribution area of the pair of second vent grooves 63 is large.

Further, in this embodiment, a plurality of medial vent grooves 60 are formed to be aligned in the shoe longitudinal direction on the medial edge side in the shoe width direction of the bottom receiving part 6, in which each of the plurality of medial vent grooves 60 includes a first vent groove 62 extending from the side edge in the shoe width direction of the bottom receiving part 6 toward the center in the shoe width direction of the bottom receiving part 6, and a pair of second vent grooves 63 branching from the inner end of the first vent groove 62 with a distance therebetween in the shoe longitudinal direction increasing toward the center in the shoe width direction of the bottom receiving part 6.

Thus, on the medial edge side in the shoe width direction of the bottom receiving part 6, a plurality of supports 64 each formed between each adjacent ones of the first vent grooves 62 in the shoe longitudinal direction and a plurality of second supports 65 each continued to the inner side (the center part side of the shoe sole 3) of each corresponding one of the first supports 64 are aligned at intervals in the shoe longitudinal direction. Thus, it is possible to suppress a decrease in cushioning properties while improving the breathability.

A third support 66 having a tapered outer end 661 is formed between each adjacent ones of the second supports 65 tapered toward the center of the shoe sole 3. That is, the second supports 65 and the third supports 66 are alternately arranged in the shoe longitudinal direction on the medial edge side in the shoe width direction of the bottom receiving part 6 to increase the number of support positions for the sole of the foot to thereby effectively suppress the decrease in cushioning properties.

Similarly, on the lateral edge side in the shoe width direction of the bottom receiving part 6, a plurality of the first supports 64 and a plurality of the second supports 65 each continued to the inner side of each corresponding one of the first supports 64 are aligned at intervals in the shoe longitudinal direction, and the second supports 65 and the third supports 66 are alternately arranged in the shoe longitudinal direction. Thus, it is possible to effectively suppress a decrease in cushioning properties while improving the breathability.

Further, according to the shoe sole 3 of this embodiment, the inner surface of the rising part 7 is stepwisely formed so that the joining surfaces 71 protrude more on the medial side in the shoe width direction than the non-contact surfaces 72, and therefore gaps are formed between the upper member 2 and thus formed escaping surfaces, and the gaps are opened to the outside by the vent holes 70. Accordingly, the gaps allowing the air to flow therethrough are formed between the lateral side of the foot and the inner side of the rising part 7, and thereby the breathability on the lateral side of the foot can be improved.

In the rising part 7 of this embodiment, a plurality of vertically elongated vent holes 70 are formed at intervals in the shoe longitudinal direction, and thus a vertically elongated columnar part 75 extending from the lower end part to the upper end of the rising part 7 is formed by a portion between each adjacent ones of the vent holes 70 in the shoe longitudinal direction. Thus, a plurality of columnar parts 75 are also formed in the rising part 7 to be arranged at intervals in the shoe longitudinal direction, to thereby increase the breathability of the rising part 7, while suppressing the decrease in the stiffness of the rising part 7 by the plurality of columnar parts 75.

Further, since the plurality of columnar parts 75 of the shoe sole 3 according to this embodiment can suppress the decrease in the stiffness of the rising part 7 even without taking measures such as separately attaching a reinforcing member to the rising part 7, ease of manufacturing can be achieved.

The shoe sole and the shoe of the present invention are not limited to the aforementioned embodiment, and it is matter of course that various modifications can be made without departing from the gist of the present invention.

In the aforementioned embodiment, the vent holes 70 are formed respectively in the medial rising part 74 and the lateral rising part 75, but the present invention is not limited to this configuration. The vent holes 70 may be formed in at least one of the medial rising part 74 and the lateral rising part 75.

In the aforementioned embodiment, the rising part 7 is formed on the medial edge side of the bottom receiving part 6 and the lateral edge side of the bottom receiving part 6, but the rising part 7 may be formed on at least one of the medial edge side and the lateral edge side.

In the aforementioned embodiment, the medial vent groove 60 and the lateral vent groove 60 are formed to face each other in the shoe width direction, but the present invention is not limited to this configuration. For example, the medial vent groove 60 and the lateral vent groove 60 may be formed to face each other in a direction inclined with respect to the shoe width direction.

In the aforementioned embodiment, the vent grooves 60 are formed on each of the medial edge side of the bottom receiving part 6 and the lateral edge side of the bottom receiving part 6, but the vent grooves 60 may be formed on at least one of the medial edge side and the lateral edge side. The number of the vent grooves 60 formed to be aligned in the shoe longitudinal direction can be appropriately determined.

Although not specifically mentioned in the aforementioned embodiment, the vent grooves 60 may be formed on the foot front side or the foot rear foot side with respect to the rising part 7.

In the aforementioned embodiment, each pair of second vent grooves 63 are configured to have a distance therebetween in the shoe longitudinal direction of the shoe sole 3 increasing toward the center in the shoe width direction of the shoe sole 3, but the present invention is not limited to this configuration. For example, each pair of second vent grooves 63 may be formed to be parallel to each other.

In the aforementioned embodiment, the pair of second vent grooves 63 of each of the vent grooves 60 is discontinuous with each other, but the present invention is not limited to this configuration. For example, the pair of second vent grooves 63 of each of the vent grooves 60 may be continuous with each other through their one ends on the center in the shoe width direction of the shoe sole 3.

In the aforementioned embodiment, each of the vent holes 70 is inclined gradually toward the rear side in the shoe longitudinal direction as it advances from the lower end side to the upper end side, but may be formed to extend straight upward, or may be inclined gradually toward the front side in the shoe longitudinal direction as it advances from the lower end side to the upper end side.

Figure 7:
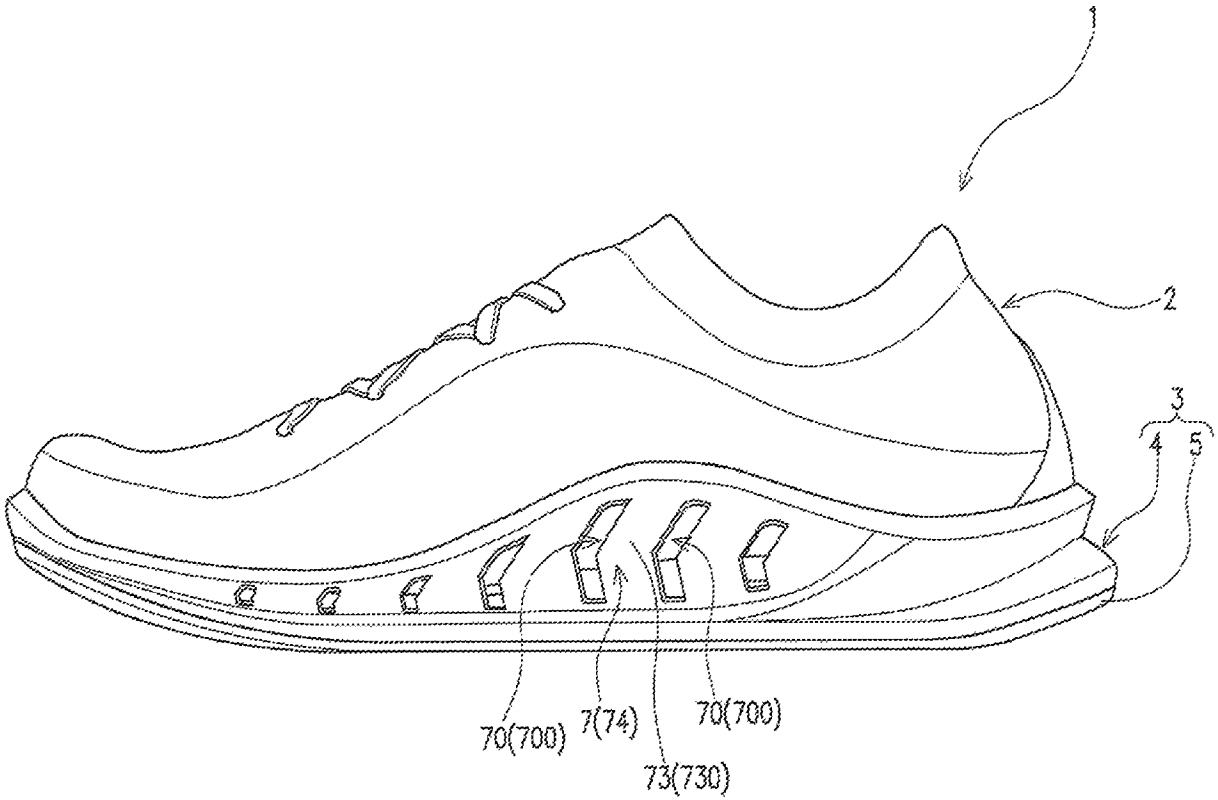
FIG. 7 is a side view of a shoe according to another embodiment of the present invention as viewed from a medial side in the shoe width direction.

In the aforementioned embodiment, each of the vent holes 70 (the medial vent hole 700, the lateral vent hole 701) is linearly formed, but the present invention is not limited to this configuration. For example, as shown in FIG. 7, each of the vent holes 70 may have a bent shape (that is, a shape having a bent portion between the lower end and the upper end) or a curved shape. The rising part 7 may be formed with both of the linear vent hole(s) 70 having a linear shape and the vent hole(s) 70 having a bent shape or a curved shape.

In the aforementioned embodiment, each of the vent holes 70 (the medial vent hole(s) 700 and the lateral vent hole(s) 701) are formed to have an opening width in the shoe longitudinal direction constant or substantially constant from the lower end part to the upper end, but the present invention is not limited to this configuration. For example, the opening width of each of the vent holes 70 in the shoe longitudinal direction may vary between the lower end and the upper end.

Figure 8:
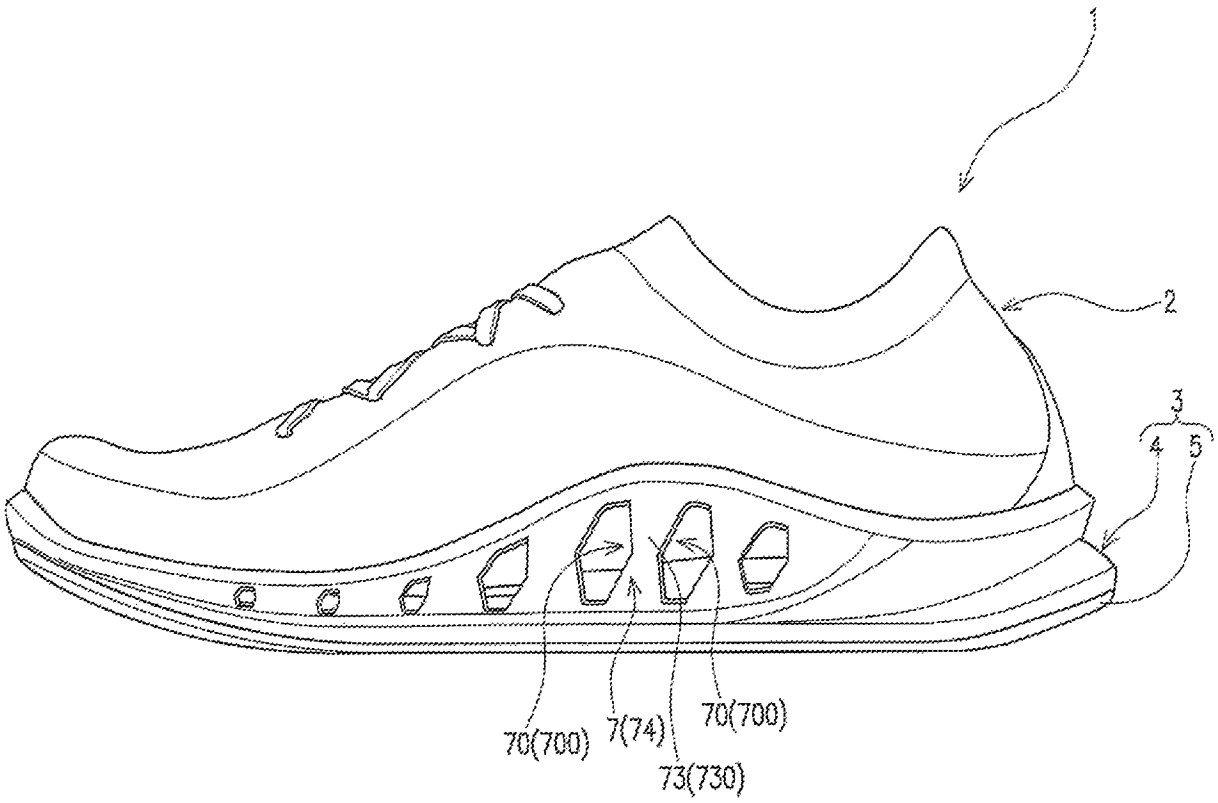
FIG. 8 is a side view of a shoe according to still another embodiment of the present invention as viewed from a medial side in the shoe width direction.
Figure 9:
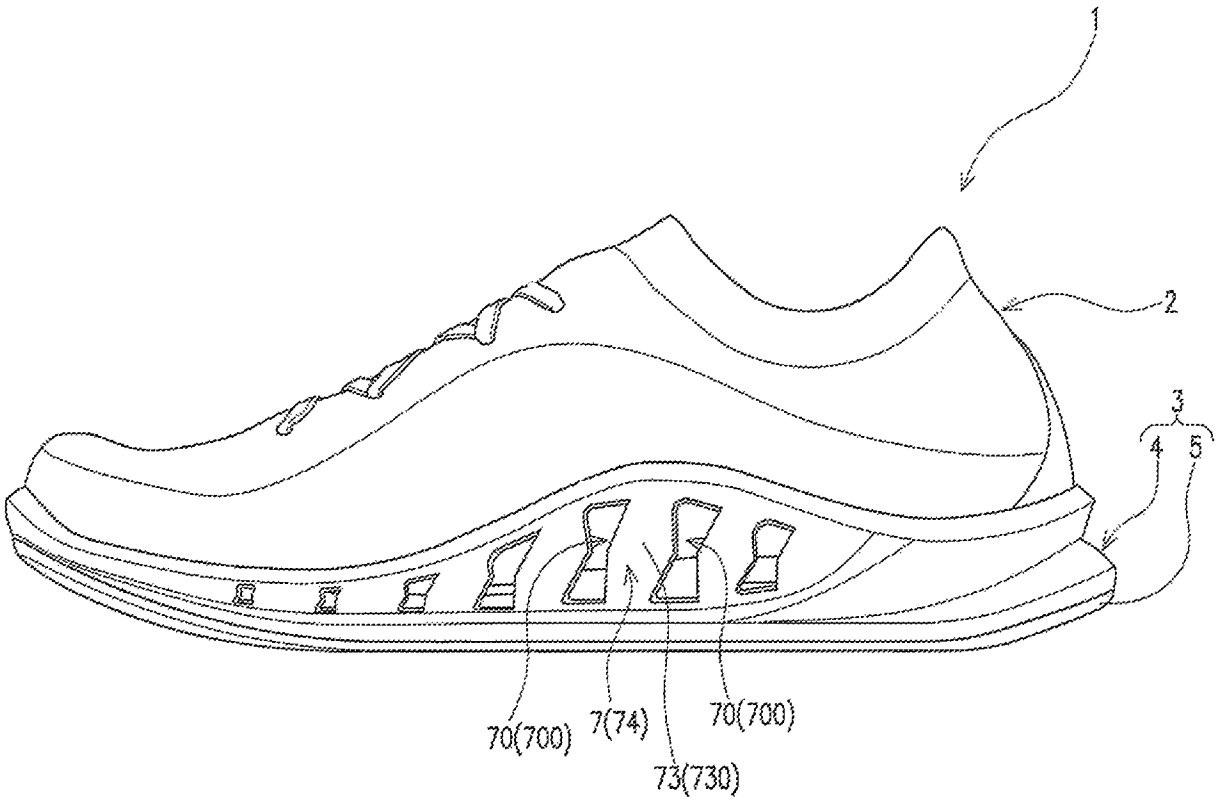
FIG. 9 is a side view of a shoe according to yet another embodiment of the present invention as viewed from a medial side in the shoe width direction.

More specifically, for example, each of the vent holes 70 may be formed so that the opening width of the center (the center in the longitudinal direction of the vent hole 70) is larger than the opening width at the upper end or the lower end as shown in FIG. 8, or may be formed so that the opening width at the center is smaller than the opening width at the upper end or the lower end as shown in FIG. 9.

In each of the vent holes 70, the opening width at the upper end may be different from the opening width at the lower end, and for example, the opening width may gradually increase as it advances from the upper end to the lower end, or the opening width may gradually decrease as it advances from the upper end to the lower end. Further, the rising part 7 may be formed with both the vent hole(s) 70 having a constant or substantially constant opening width and the vent hole(s) 70 having a non-constant opening width.

Although not specifically mentioned in the aforementioned embodiment, one side of the upper end defining each of the vent holes 70 and one side of the lower end defining each of the vent holes 70 may be set to be parallel or substantially parallel to each other, or may be set so that the direction in which one side of the upper end extends and the direction in which one side of the lower end extends intersect with each other. Further, one side defining the vent hole 70 on the front side in the shoe longitudinal direction and one side defining the vent hole 70 on the rear side in the shoe longitudinal direction may be set to be parallel or substantially parallel to each other, or may be set to intersect with the direction in which the one side of the front side extends with the direction in which the one side of the rear side extends.

Although not specifically mentioned in the aforementioned embodiment, each of the sides defining the vent hole 70 may be linear or curved.

REFERENCE SIGNS LIST

1: Shoe
2: Upper member
3: Shoe sole
4: Midsole
5: Outsole
6: Bottom receiving part
7: Rising part
60: Vent groove (Medial vent groove, Lateral vent groove)
60: Vent groove
61: Longitudinal groove
62: First vent groove

63: Second vent groove
64: First support
65: Second support
66: Third support
67: Intersection space
70: Vent hole
71: Joining surface
72: Non-contact surface
73: Columnar part
74: Medial rising part
75: Lateral rising part
660: Medial edge
661: Lateral edge
700: Medial vent hole
701: Lateral vent hole

The invention claimed is:

1. A shoe sole, to which an upper member is joined, the shoe sole comprising a bottom receiving part, to which the upper member is directly or indirectly layered, and a rising part that is formed to rise upwardly from an upper side of the bottom receiving part so as to cover an outer surface of the side of the upper member, wherein the bottom receiving part is formed with at least one vent groove that is recessed in a thickness direction from the upper surface of the bottom receiving part, wherein the rising part is formed with at least one vent hole that penetrates therethrough in a shoe width direction of the shoe sole, wherein the vent hole is formed to have a vertically elongated shape extending from an upper end side to a lower end side of the rising part, and to be in communication with the vent groove, wherein the rising part has an inner surface comprising a joining surface, to which the upper member is joined, and a non-contact surface configured to be in non-contact with the upper member, and wherein the inner surface of the rising part is stepwisely formed so that the joining surface protrudes more on the medial side in the shoe width direction than the non-contact surface.

2. The shoe sole according to claim 1, wherein the vent groove comprises a first vent groove extending straight from the vent hole toward a center in the shoe width direction of the shoe sole, and a pair of second vent grooves branching from a medial end in the shoe width direction of the first vent groove.

3. The shoe sole according to claim 2, wherein the distance between the pair of second vent grooves in the shoe longitudinal direction increases, as they advance toward the medial side in the shoe width direction.

4. The shoe sole according to claim 2, wherein the rising part comprises a medial rising part that is formed on a medial edge side in the shoe width direction of the bottom receiving part, and a lateral rising part that is formed on a lateral edge side in the shoe width direction of the bottom receiving part, wherein the at least one vent hole is composed of a plurality of vent holes, wherein the plurality of vent holes comprise a medial vent hole formed in the medial rising part and a lateral vent hole formed in the lateral rising part, wherein the at least one vent groove is composed of a plurality of vent grooves, wherein the plurality of vent grooves comprise a medial vent groove that is located on the medial edge side of the bottom receiving part and continued to the medial vent hole, and a lateral vent groove that is located on the lateral edge side of the bottom receiving part and continued to the lateral vent hole, and wherein ends of the pair of second vent grooves included in the medial vent groove and ends of the pair of second vent grooves included in the lateral vent groove are respectively in communication with each other in the shoe width direction.

5. The shoe sole according to claim 1, wherein the plurality of vent holes are formed in the rising part at intervals in the shoe longitudinal direction of the shoe sole, and wherein a vertically elongated columnar part extending from a lower end part to an upper end of the rising part is formed by a portion between each adjacent ones of the vent holes in the shoe longitudinal direction.

6. A shoe comprising the shoe sole according to claim 1, to which an upper member is joined.

* * * * *